US007980917B2

(12) United States Patent
Guzman

(10) Patent No.: US 7,980,917 B2
(45) Date of Patent: Jul. 19, 2011

(54) FOOTWEAR AND TOY VEHICLE ENTERTAINMENT DEVICE

(75) Inventor: Rudy Guzman, Coral Springs, FL (US)

(73) Assignee: BBC International LLC, Boca Raton, FL (US)

( * ) Notice: Subject to any disclaimer, the term of this patent is extended or adjusted under 35 U.S.C. 154(b) by 269 days.

(21) Appl. No.: 12/409,553

(22) Filed: Mar. 24, 2009

(65) Prior Publication Data

US 2010/0248587 A1 Sep. 30, 2010

(51) Int. Cl.
*A63H 30/04* (2006.01)

(52) U.S. Cl. ..... 446/456; 446/410

(58) Field of Classification Search ..... 446/456
See application file for complete search history.

(56) References Cited

U.S. PATENT DOCUMENTS

| | | | | |
|---|---|---|---|---|
| 4,112,615 | A * | 9/1978 | Ishimoto | 446/456 |
| 4,171,592 | A | 10/1979 | Saitoh | |
| 4,655,724 | A * | 4/1987 | Law | 446/443 |
| 6,788,200 | B1 | 9/2004 | Jamel et al. | |
| 6,821,184 | B1 | 11/2004 | Yeung | |
| 2002/0111110 | A1 * | 8/2002 | Buford et al. | 446/279 |
| 2003/0009308 | A1 | 1/2003 | Kirtley | |
| 2004/0078091 | A1 * | 4/2004 | Elkins | 623/24 |
| 2005/0164601 | A1 | 7/2005 | McEachen et al. | |
| 2007/0129907 | A1 | 6/2007 | Demon | |
| 2007/0164521 | A1 * | 7/2007 | Robinson | 280/11.19 |
| 2007/0247306 | A1 | 10/2007 | Case, Jr. | |
| 2008/0167741 | A1 | 7/2008 | Lay et al. | |
| 2008/0177400 | A1 | 7/2008 | Chiang | |
| 2008/0218310 | A1 | 9/2008 | Alten et al. | |
| 2008/0243265 | A1 | 10/2008 | Lanier et al. | |

FOREIGN PATENT DOCUMENTS

| | | | |
|---|---|---|---|
| CN | 1474423 | A2 | 2/2004 |
| DE | 19847636 | A1 | 11/1999 |
| DE | 19832512 | A1 | 1/2000 |
| FR | 2646545 | A1 | 11/1990 |
| JP | 06348335 | A | 12/1994 |

* cited by examiner

*Primary Examiner* — Melba Bumgarner
*Assistant Examiner* — Tramar Harper
(74) *Attorney, Agent, or Firm* — GrayRobinson, PA

(57) ABSTRACT

An entertainment device is provided comprising the combination of an article of footwear and a self-propelled toy vehicle whose operation may be rudimentarily controlled by the actuation of one or more sensors mounted to the outsole or upper of the article of footwear.

21 Claims, 3 Drawing Sheets

FOOTWEAR AND TOY VEHICLE ENTERTAINMENT DEVICE

FIELD OF THE INVENTION

This invention relates to child entertainment devices, and, more particularly, to the combination of an article of footwear and a toy vehicle in which one or more sensors located on the outsole of the footwear cause an RF control signal to be sent to the vehicle inducing forward movement, right or left-hand turns, or, rearward movement in the event the sensor(s) are not actuated within a predetermined time period.

BACKGROUND OF THE INVENTION

Remote controlled, self-propelled toy vehicles such as cars or trucks have been in use for years. In many designs, a control module having a joy stick or other steering device is coupled to a circuit that includes an RF transmitter capable of producing control signals in response to input from the steering device. These signals are transmitted to an RF receiver in the vehicle coupled to a circuit that controls movement of the wheels of the vehicle and the motor that propels it. More sophisticated designs have modules with controls for braking, acceleration and other functions of the vehicle.

Manipulation of a number of controls on a module requires a degree of skill and manual dexterity that younger children may not possess. Further, the more sophisticated the vehicle system the more expensive. Many parents are unwilling to entrust a younger child with a plaything that is relatively expensive and may be readily easily damaged.

SUMMARY OF THE INVENTION

This invention is directed to an entertainment device comprising the combination of an article of footwear and a self-propelled toy vehicle whose operation may be rudimentarily controlled by the actuation of one or more sensors mounted to the outsole or upper of the article of footwear.

In one presently preferred embodiment, a forward sensor is located in the heel or toe area of the bottom of the outsole of a children's article of footwear, such as a shoe, in position to engage a surface on which the child is walking. An electrical circuit in the shoe produces an RF signal in response to actuation of the forward sensor which is transmitted to an RF receiver coupled to a circuit in the vehicle. The circuit in the vehicle causes it to move forward, making it appear as if the vehicle is following the child as he or she walks. If the child stops walking or there is otherwise a delay in actuating the forward sensor for a selected period of time, the circuit in the vehicle causes it to turn the front wheels and reverse direction so that the vehicle travels in a circle, in reverse. Forward motion of the vehicle is resumed when the forward sensor in the shoe is again actuated.

An alternative embodiment of this invention adds the capability of turning the vehicle left or right by the actuation of additional sensors located on the shoe bottom or elsewhere on the shoe. Preferably, a right-hand sensor and a left-hand sensor are provided in addition to the forward sensor described above. Actuation of the right-hand sensor or the left-hand sensor causes the vehicle to turn to the right or left, as the case may be. The same reverse motion of the vehicle while turning in a circle, as described above, occurs in this embodiment when no control signals are received from the RF transmitter in the shoe.

BRIEF DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
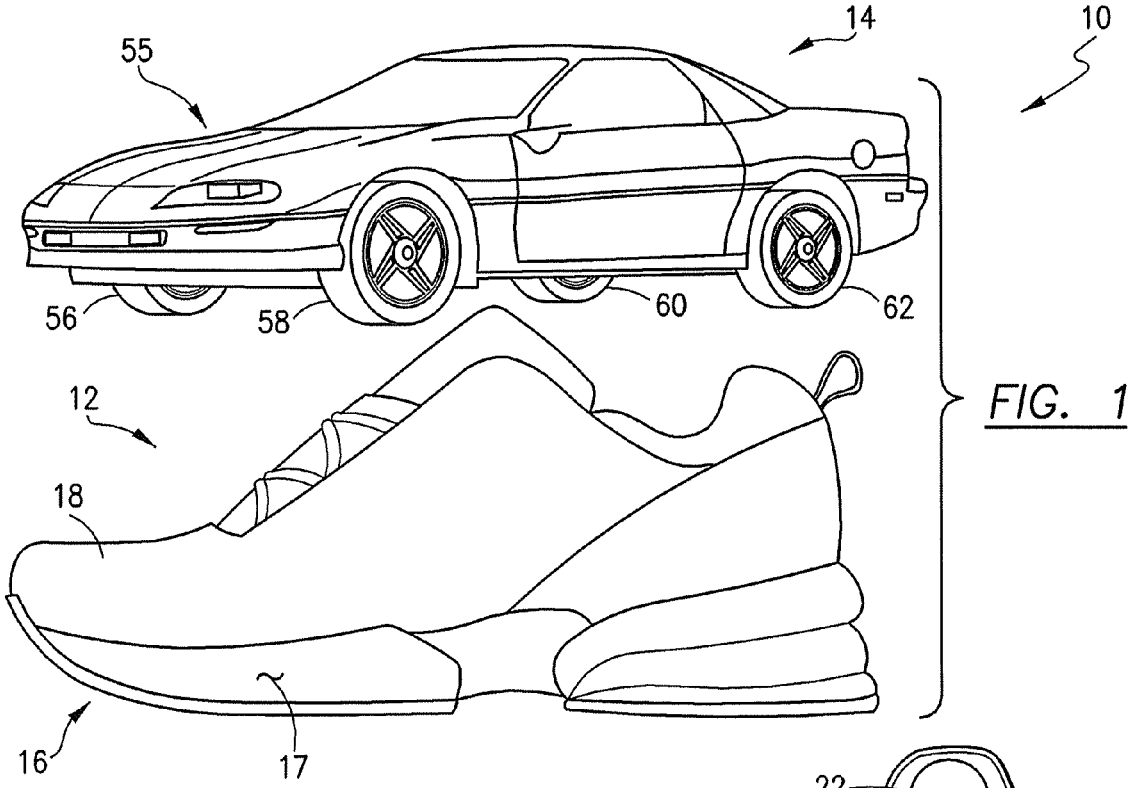
FIG. 1 is perspective view of an article of footwear and a self-propelled car according to this invention.

Referring initially FIG. 1, the entertainment device 10 of this invention comprises the combination of an article of footwear, such as a shoe 12, and a self-propelled vehicle such as a toy car 14. It should be understood that essentially any article of footwear could be employed in the device 10 herein, and the shoe 12 is depicted for purposes of illustration. Additionally, a car 14 is shown in FIG. 1 but other types of self-propelled toy vehicles may be suitable for use with the device 10 of this invention. As discussed in detail below, movement of the shoe 12 is effective to rudimentarily control the operation of car 14 for the entertainment of the child wearing the shoe 12.

The shoe 12 conventionally includes an outsole 16 connected to an upper 18. In the embodiment of this invention illustrated in FIG. 2, the outsole 16 has a bottom surface 20 which mounts a forward sensor 22. While the forward sensor 22 is located in the toe area of the shoe 12 in FIG. 2, it is contemplated that it could be mounted in the arch, heel or other area of the shoe 12 so long as it is in a position to contact a floor, the ground or other surface on which the wearer of the shoe 12 is walking. The forward sensor 22 may take the form of a pressure sensitive switch which is effective to move from an open position to a closed position in response to contact with a surface.

Figure 3:
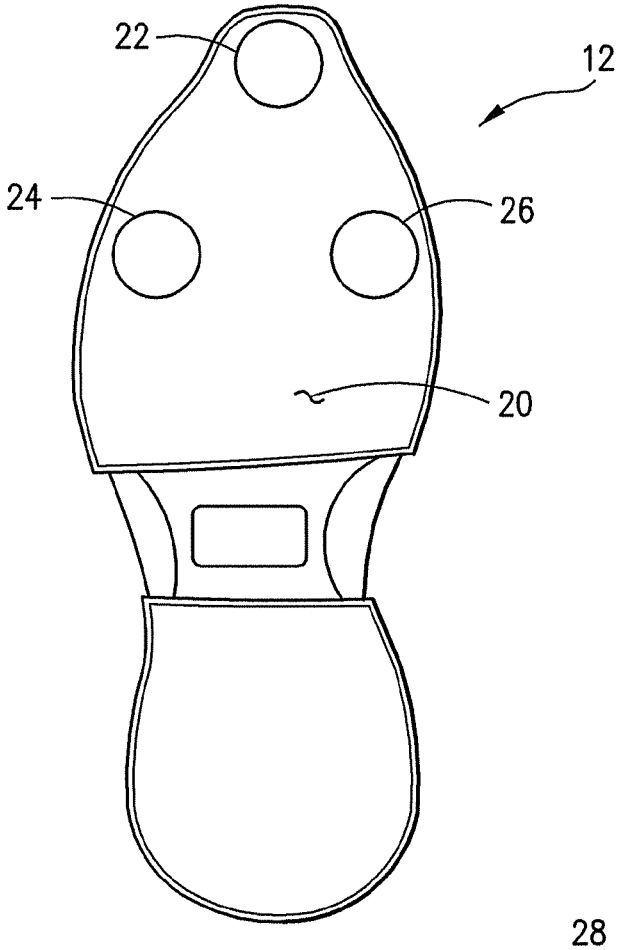
FIG. 3 is a bottom view of an alternative embodiment of the shoe of FIG. 1 illustrating one possible location of a forward sensor, a right-turn sensor and a left-turn sensor.

In an alternative embodiment of the shoe 12, the bottom surface 20 of its outsole 16 may mount a night-turn sensor 24 and a left-turn sensor 26 in addition to the forward sensor 22 described above. Such sensors 24 and 26 may be pressure sensitive switches like the forward sensor 22. As shown in FIG. 3, the right-turn sensor 24 and left-turn sensor 26 may be located in the toe area of the outsole 16, on either side of the forward sensor 22. Additionally, the sensors 24, 26 may be mounted at other locations on the bottom surface 20 of the outsole 16 in position to contact a surface when the wearer of the shoe 12 is walking. Alternatively, it is contemplated that the sensors 24, 26 may be mounted along the side wall 17 of the outsole 16, or at some other location on the outsole 16 or upper 18, so that they are not contacted by walking in the shoe 12. When mounted on the upper 18 of the shoe 14, the sensors 24, 26 may be actuated manually. If the sensors 24, 26 are located on the side wall 17 of the shoe outsole 16, they may be actuated manually or by tilting the shoe 12 on edge so that the side wall 17 of the outsole 16, and the sensors 24, 26, contact the floor or ground.

Figure 4:
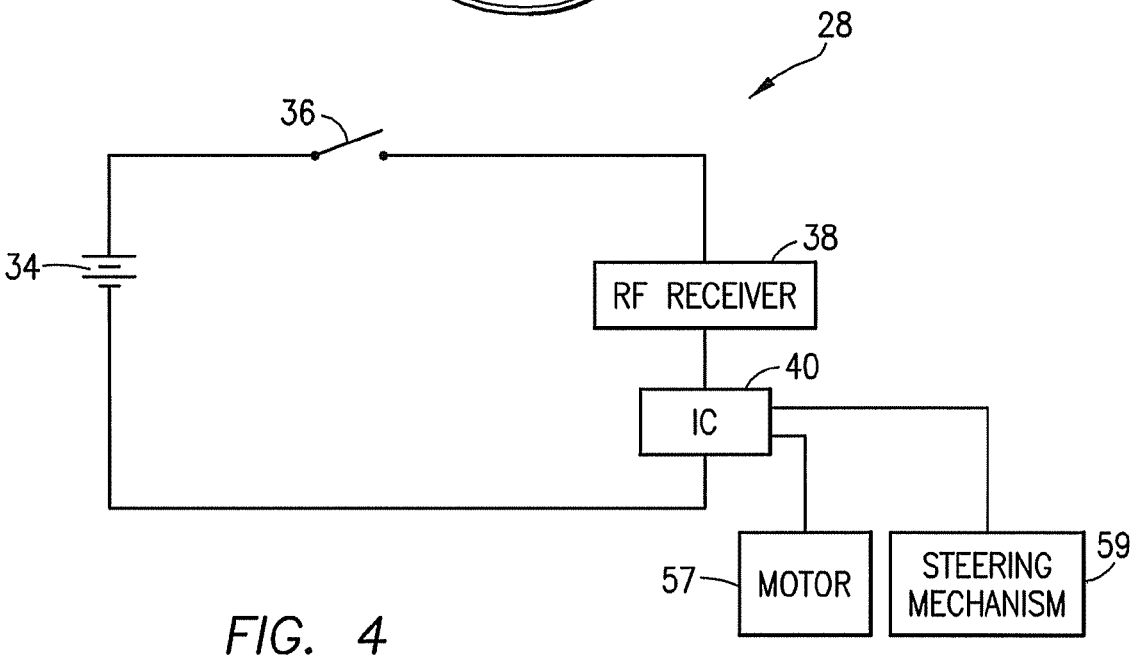
FIG. 4 is a schematic view of an electrical circuit carried in the self-propelled car shown in FIG. 1.
Figure 5:
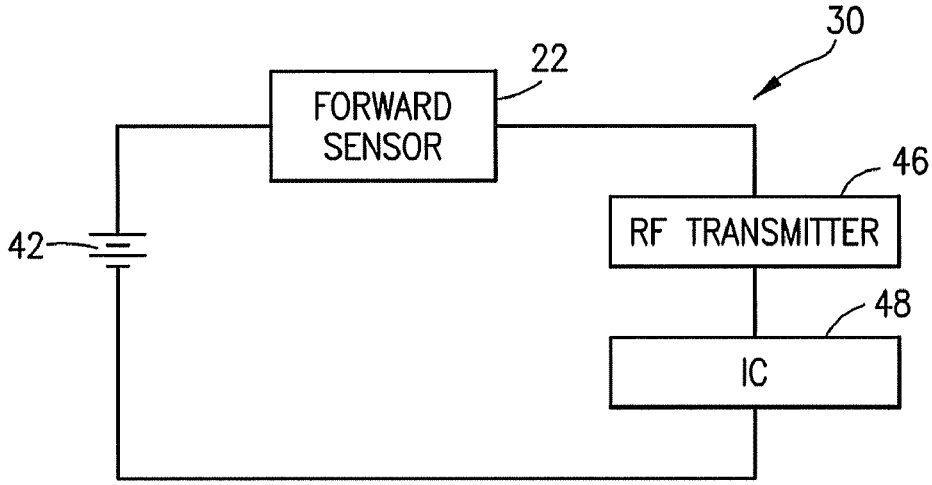
FIG. 5 is a schematic view of an electrical circuit carried by the embodiment of the shoe shown in FIG. 2.
Figure 6:
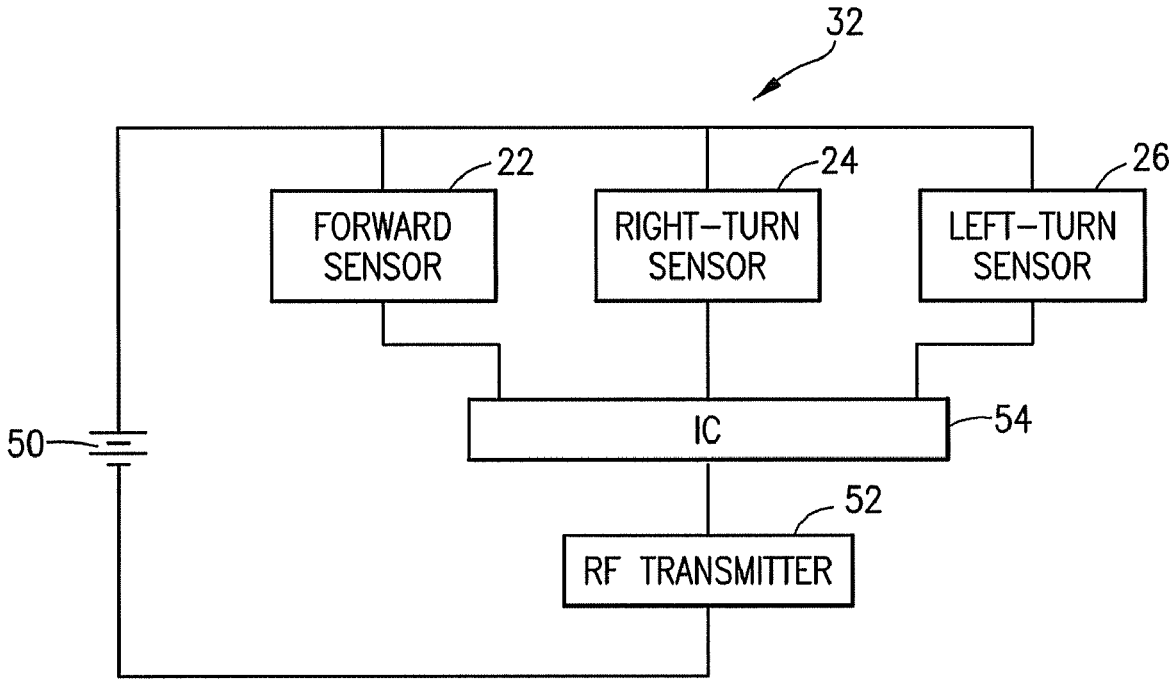
FIG. 6 is a schematic view of an electrical circuit carried by the embodiment of the shoe shown in FIG. 3.

Referring now to FIGS. 4-6, schematic views are shown of an electrical circuit 28 carried by the car 14, and electrical circuits 30 and 32 mounted in or on the shoe 12. Considering first FIG. 4, the circuit 28 comprises a battery 34, an on/off switch 36, an RF receiver 38 and an integrated circuit (IC) 40. The circuit 30 shown in FIG. 5 is intended for use with the embodiment of the shoe 12 illustrated in FIG. 2 having only the forward sensor 22. It comprises a battery 42, the forward sensor 22, an RF transmitter 46 and an IC 48. The embodiment of the shoe 12 depicted in FIG. 3, having forward, right-hand and left-hand sensors 22, 24 and 26, mounts the circuit 32 depicted in FIG. 6 having a battery 50, the forward sensor 22, the right-turn sensor 24, the left-turn sensor 26, an RF transmitter 52 and an IC 54.

The entertainment device 10 operates as follows. Initially, it should be understood that the self-propelled car 14 utilized in the device 10 of this invention can be essentially any commercially available, radio-controlled, battery operated vehicle, the details of which form no part of this invention and are therefore not described herein. For purposes of the present discussion, the car 14 is considered to include a vehicle body 55 which carries a battery-operated reversible motor 57 and a steering mechanism 59 capable of turning the front wheels 56 and 58 of the car 14 from a neutral position to the right to make a right-turn, or to the left to make a left turn. The term "neutral" as used herein refers to the position in which the front wheels 56, 58 are substantially parallel to the back wheels 60, 62. The motor 57 and steering mechanism 59 are schematically depicted in FIG. 4 as being coupled to the IC 40 of the electrical circuit 28.

Unlike many conventional radio-controlled vehicles, no control module or other hand-held controller is employed in this invention to govern the operation of the car 14. Instead, rudimentary operation of the car 14 is achieved in response to actuation of the sensors 22, 24 or 26 mounted to the shoe 12. Considering initially the embodiment illustrated in FIGS. 2, 4 and 5, and assuming that the on/off switch 36 in the car circuit 28 is in the "on" position, normal walking in the shoe 12 causes the forward sensor 22 to be actuated upon contact with a surface such as the floor or ground. In response to actuation of the forward sensor 22, the IC 48 in the circuit 30 on or in the shoe 12 is effective to cause the RF transmitter 46 to send a signal to the RF receiver 38 on the car 14. The IC 40 of the circuit 28 on the car 14, in turn, initiates operation of the motor 57 of the car 14 and causes the front wheels 56, 58 to assume the neutral position. As a result, the car 14 moves in a straight line in a forward direction and has the appearance as if it is following the child wearing the shoe 12 as he or she walks.

In the presently preferred embodiment, the IC 40 in the car 14 has a timing feature wherein it will continue to operate the motor 57 and maintain the front wheels 56, 58 in the neutral position so long as its on/off switch 36 remains in the "on" position and signals from the RF transmitter 46 in the shoe 12 are input to the RF receiver 38 in the car 14. Should signals not be received by the RF receiver 38 after the passage of a selected period of time, typically several seconds, then the IC 40 in the car 14 operates to reverse the direction of the motor 57 and turn the front wheels 56, 58 to the right or to the left. The car 14 reacts by moving in a circle, in reverse.

Movement of the car 14 in the forward direction resumes upon input of a new signal from the RF transmitter 46 in the shoe 12 to the RF receiver 38 in the car 14. The term "new" in this context is meant to refer to the first or initial signal from the RF transmitter 46 after the period during which no signals were produced. Such new signal may be output from the RF transmitter 46 when the child wearing the shoe 12 begins walking again after stopping for a period of time. It can be appreciated that the direction of forward movement of the car 14 may be changed by employing the above-described feature of this invention. After the car 14 moves forward in a particular direction for a period of time, e.g. a first forward direction, the child wearing the shoe 12 may stop walking until the car 14 begins moving in reverse, in a circle, as described above. The child may stop such reverse, circular movement of the car at any time by actuating the forward sensor 22, and, depending on the orientation of the front of the car 14 when a new signal from the RF transmitter 46 is produced, the car 14 will move in such direction upon resumption of forward movement. The forward direction of the car 14 after resumption of forward movement may be the same as the first forward direction or a different forward direction.

Referring now to FIGS. 3, 4 and 6, the alternative embodiment of this invention is depicted in which the bottom surface 20 of the outsole 16 mounts a right-turn sensor 24 and a left-turn sensor 26 in addition to the forward sensor 22. The operation of the car 14 with the addition of sensors 24 and 26 is similar to that described above in connection with a discussion of FIGS. 2 and 4. Specifically, the car 14 moves in the forward direction with its front wheels 56, 58 in the neutral position upon actuation of the forward sensor 22. Motion continues in the forward direction in a straight line, or with a light or left turn as described below, so long as a signal resulting from actuation of one of the sensors 22, 24 or 26 is input from the RF transmitter 52 to the RF receiver 38 within a selected time period. Additionally, the car 14 moves in a circular reverse motion if the RF receiver 38 in the shoe 12 does not receive a signal resulting from actuation of any of the sensors 22, 24 or 26 for such selected period of time. Resumption of forward motion of the car 14 occurs following reverse circular motion of the car 14 once a new signal is input by RF transmitter 52 to the RF receiver 38 when any of the sensors 22, 24 or 26 is actuated.

Figure 2:
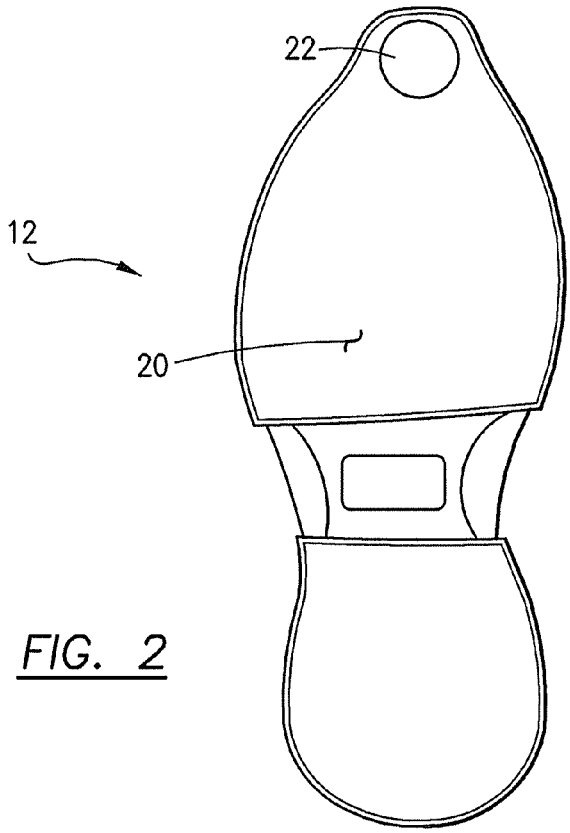
FIG. 2 is a bottom view of one embodiment of the shoe depicted in FIG. 1 showing the positioning of a forward sensor.

The primary difference in the embodiment of FIGS. 3, 4 and 6 compared to that of FIGS. 2, 4 and 5 is the addition of right and left turning ability to the car 14. In response to actuation of the night-turn sensor 24, the IC 54 causes a control signal to be transmitted from the RF transmitter 52 in the shoe 14 to the RF receiver 38 in the car 14. The IC 40 in the car 14 is effective to turn its front wheels 56, 58 from the neutral position to the right so that the car 14 turns in that direction. The front wheels 56, 58 are returned to the neutral position, so that the car 14 moves forward in a straight line, when the forward sensor 22 is actuated. The same sequence applies to a left turn. Upon actuation of the left-turn sensor 26, the IC 54 in the shoe 12 causes a control signal from the RF transmitter 52 to be input to the RF receiver 38 in the car 14. The front wheels 56, 58 are then turned to the left to execute a left-hand turn. Movement of the car 14 in a straight-line, forward direction resumes upon actuation of the forward sensor 22.

The device 10 of this invention provides for rudimentary control of the movement of a self-propelled toy car 14 by simple walking or other movements of a shoe 12 that can be performed by younger children. Additionally, the entertainment aspect of the device is enhanced by providing reverse, circular movement of the car 14 when the child stops walking for a selected time period.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. Apparatus for entertaining a child, comprising:

an article of footwear which is to be worn on a foot of the child, including:

(i) an upper connected to an outsole;

(ii) a first electrical circuit carried by at least one of said upper and said outsole, said first electrical circuit having at least one battery, an RF transmitter and a first integrated circuit;

(iii) a forward sensor coupled to said first electrical circuit, said forward sensor being mounted to said outsole in position to be actuated in response to each contact with a surface on which the child wearing the article of footwear is walking or running in a forward direction, said first integrated circuit being effective to cause said RF transmitter to emit a first signal in response to each actuation of said forward sensor;

a toy vehicle, including:

(i) a vehicle body having at least one front wheel and at least one rear wheel;

(ii) a second electrical circuit carried by said vehicle body, said second electrical circuit having at least one battery, an RF receiver, a second integrated circuit and a switch;

(iii) a motor coupled to said second electrical circuit, said motor being drivingly connected to said at least one rear wheel or front wheel;

whereby in response to input of said first signal to said RF receiver in said vehicle said second integrated circuit in said vehicle is effective to activate said motor to cause said toy vehicle to move in the same forward direction as the child wearing the article of footwear is walking or running.

2. The apparatus of claim 1 in which said outsole has a toe area and a heel area, said sensor being mounted in said toe area of said outsole.

3. The apparatus of claim 1 in which said RF transmitter in said article of footwear is effective to send a first signal to said RF receiver in said vehicle at each occurrence of said actuation of said forward sensor.

4. The apparatus of claim 3 in which said second integrated circuit in said vehicle is effective to activate said motor to create movement of said vehicle in the forward direction so long as a new first signal is input to said RF receiver within a selected period of time from the input of an immediately preceding first signal.

5. The apparatus of claim 4 in which said second integrated circuit is effective to deactivate said motor in the event said new first signal is not input to said RF receiver in said vehicle within said selected period of time.

6. The apparatus of claim 5 in which said second integrated circuit is effective, after said deactivation of said motor, to activate said motor so that said vehicle moves in a reverse direction.

7. The apparatus of claim 6 in which said second circuit is effective, upon movement of said vehicle in the reverse direction, to cause said at least one front wheel to turn from a neutral position so that said vehicle moves substantially in a circle.

8. The apparatus of claim 7 in which said second integrated circuit is effective, upon receipt of a new first signal following movement of said vehicle substantially in a circle, to deactivate said motor, to cause said at least one front wheel to return to said neutral position, and to activate said motor so that said vehicle moves in a new forward direction which is the same direction as the child wearing the article of footwear is walking or running.

9. The apparatus of claim 8 in which said forward sensor may be actuated to cause the generation of a new first signal at any time while said vehicle is moving substantially in a circle.

10. The apparatus of claim 1 further including a left-turn sensor and a right-turn sensor coupled to said first electrical circuit in said article of footwear, said left-turn sensor being mounted on said outsole in position to be actuated in response to each contact with said surface, said right-hand sensor being mounted on said outsole in position to be actuated in response to each contact with said surface.

11. The apparatus of claim 10 in which said first integrated circuit is effective to cause said RF transmitter to emit a second signal in response to actuation of said left-turn sensor and to emit a third signal in response to actuation of said right-turn signal.

12. The apparatus of claim 11 in which said second integrated circuit is effective, upon input of a second signal to said RF receiver, to cause said at least one front wheel to move so that said vehicle turns to the left.

13. The apparatus of claim 11 in which said second integrated circuit is effective, upon input of said third signal to said RF receiver, to cause said at least one front wheel to move so that said vehicle turns to the right.

14. Apparatus for entertaining a child, comprising:

an article of footwear which is to be worn on the foot of the child, including:

(i) an upper connected to an outsole;

(ii) a first electrical circuit carried by at least one of said upper and said outsole, said first electrical circuit having at least one battery, an RF transmitter and a first integrated circuit;

(iii) a forward sensor, a right-turn sensor and a left-turn sensor all coupled to said first electrical circuit, each of said forward sensor, right-turn sensor and left turn sensor being mounted to said outsole in position to be actuated in response to each contact with a surface on which the child is walking or running, said first integrated circuit being effective to cause said RF transmitter to emit a first signal in response to actuation of said forward sensor, to emit a second signal in response to actuation of said right-turn sensor and to emit a third signal in response to actuation of said left-turn sensor;

a toy vehicle, including:

(i) a vehicle body having at least one front wheel and at least one rear wheel;

(ii) a second electrical circuit carried by said vehicle body, said second electrical circuit having at least one battery, an RF receiver, a second integrated circuit and a switch;

(iii) a motor coupled to said second electrical circuit, said motor being drivingly connected to said at least one rear wheel or front wheel;

whereby in response to input of said first signal to said RF receiver in said vehicle said second integrated circuit in said vehicle is effective to activate said motor to cause said toy vehicle to move in a first forward direction, said second integrated circuit being effective to cause said vehicle to turn to the right in response to input of said second signal to said RF receiver and said second integrated circuit being effective to cause said vehicle to turn to the left in response to input of said third signal to said RF receiver.

15. The apparatus of claim 14 in which said outsole has a toe area and a heel area, said forward sensor, right-turn sensor and left-turn sensor each being mounted in said toe area of said outsole.

16. The apparatus of claim 14 in which said RF transmitter in said article of footwear is effective to send a first signal, a second signal or a third signal to said RF receiver in said vehicle at each occurrence of said actuation of a respective one of said forward sensor, right-turn sensor and left-turn sensor.

17. The apparatus of claim 16 in which said second integrated circuit in said vehicle is effective to activate said motor to create movement of said vehicle so long as a new first signal, a new second signal or a new third signal is input to said RF receiver within a selected period of time from the input of an immediately preceding one of said first signal, second signal or third signal.

18. The apparatus of claim 17 in which said second integrated circuit is effective to deactivate said motor in the event at least one of said new first signal, said new second signal or said new third signal is not input to said RF receiver in said vehicle within said selected period of time.

19. The apparatus of claim 18 in which said second integrated circuit is effective, after said deactivation of said motor, to activate said motor so that said vehicle moves in a reverse direction.

20. The apparatus of claim 19 in which said second circuit is effective, upon movement of said vehicle in the reverse direction, to cause said at least one front wheel to turn from a neutral position so that said vehicle moves substantially in a circle.

21. The apparatus of claim 20 in which said second integrated circuit is effective, upon receipt of a new first signal, a new second signal or a new third signal, following movement of said vehicle substantially in a circle, to deactivate said motor, to cause said at least one front wheel to return to said neutral position, and to activate said motor so that said vehicle moves in a new forward direction.

* * * * *